United States Patent [19]

Barrett et al.

[11] 4,293,088

[45] Oct. 6, 1981

[54] ELECTRONICALLY OPERATED PORTABLE FASTENER DRIVING TOOL

[75] Inventors: Edward E. Barrett, Massapequa Park; Steven Hahn, East Hampton; Albert Lensky, Fresh Meadow; Morris Pinczewski, New York; Seymour Sobelman, Brooklyn, all of N.Y.

[73] Assignee: Swingline Inc., Long Island City, N.Y.

[21] Appl. No.: 84,450

[22] Filed: Oct. 12, 1979

[51] Int. Cl.[3] ..... B25C 1/06

[52] U.S. Cl. ..... 227/131; 227/120

[58] Field of Search ..... 173/117; 227/109, 114, 227/115, 116, 120, 123, 127, 128, 131

[56] References Cited

U.S. PATENT DOCUMENTS

| | | | |
|---|---|---|---|
| 3,179,866 | 4/1965 | Doyle et al. | 318/125 |
| 3,215,864 | 11/1965 | Doyle et al. | 307/88.5 |
| 3,267,337 | 8/1966 | Doyle et al. | 317/148.5 |
| 3,281,046 | 10/1966 | Boulay | 227/121 |
| 3,552,627 | 1/1971 | Moreno | 227/121 |
| 3,589,587 | 6/1971 | Manganaro | 227/131 |
| 3,786,978 | 1/1974 | Manganaro | 227/131 |
| 3,893,610 | 7/1975 | Smith | 227/116 |
| 3,971,969 | 7/1976 | Wines et al. | 310/30 |
| 4,005,812 | 2/1977 | Doyle et al. | 227/131 |
| 4,033,500 | 7/1977 | Manganaro | 227/131 |
| 4,183,453 | 1/1980 | Barrett et al. | 227/131 |

OTHER PUBLICATIONS

General Electric SCR Mannual, Fifth Ed., pp. 202–203, 1972.

*Primary Examiner*—Paul A. Bell
*Attorney, Agent, or Firm*—Pennie & Edmonds

[57] ABSTRACT

An electronically operated portable fastener driving tool is disclosed. Fasteners are driven into a workpiece by a driver blade which is actuated by a solenoid powered by a source of alternating current. Each actuation of the device produces two driving strokes delivered to a fastener. The tool is also provided with means for preventing more than one fastener from being driven during each actuation of the tool. A preferred embodiment in which the device is double insulated is disclosed. Control circuits which permit operation at either 110 V. or 220 V. are also disclosed.

14 Claims, 7 Drawing Figures

90
94
92
90
94
96
3
3
T
315
292
290
260
292
160
280
270
275
300
340
320
310
330
C
F

A.C.
A.C.
D3
R7
Q3
C4
C3

A.C.
A.C.
D3
R7
Q3
C4
C3
5A
5A
R8
Q2
C2
D2
R6
Q1
R5
FUSE
COIL
SCR
R2
C5
R4
D1
R9
R3
SW
B
A
C1
+
R1

ELECTRONICALLY OPERATED PORTABLE FASTENER DRIVING TOOL

BACKGROUND OF THE INVENTION

This invention relates to electrically operated fastener driving tools and, more particularly, to devices of this type which are provided with electronic control circuitry for supplying multiple unidirectional electronic impulses to a solenoid which powers the fastener driving blade of the device. This results in the delivery of a like number of driving strokes to a single fastener for each actuation of the tool. Means is also provided for preventing the advancement of more than one fastener into the path of the driver blade during the driving strokes produced in a single actuation of the device.

An electronically operated fastener driving tool is disclosed in application Ser. No. 880,846, filed Feb. 23, 1978 and is assigned to the assignee of this application. The cited application includes circuitry comprising only diodes, resistors, capacitors and a single SCR to provide a predetermined plurality of unidirectional current pulses to the solenoid during consecutive like-poled half-cycles of alternating current so that the driver blade will deliver a predetermined plurality of driving strokes, preferably two, for a single actuation of the tool. In the cited application there is also disclosed alternative mechanical means responsive to the activating mechanism of the tool, to prevent more than one fastener in a strip of fasteners from being advanced into the path of the driver blade during a single actuation of the tool.

SUMMARY OF THE INVENTION

This invention relates to a double insulated electrically powered fastener driving tool having an electronic trigger control circuit mounted therein for producing two driving strokes to a fastener and means for preventing the advancement of a second fastener into the driving path while a first fastener is being driven.

The present invention utilizes a two-shot trigger control circuit in which an SCR is fired twice by a timing circuit which includes transistors. This trigger circuit may be used on either a 110 V. or 220 V. AC line depending on the values of the circuit components. Rectification in the circuit, in either of its modes, is accomplished by a capacitor.

DETAILED DESCRIPTION OF THE PREFERRED EMBODIMENT

I. Electronic Circuitry

Figures 5, 5A:
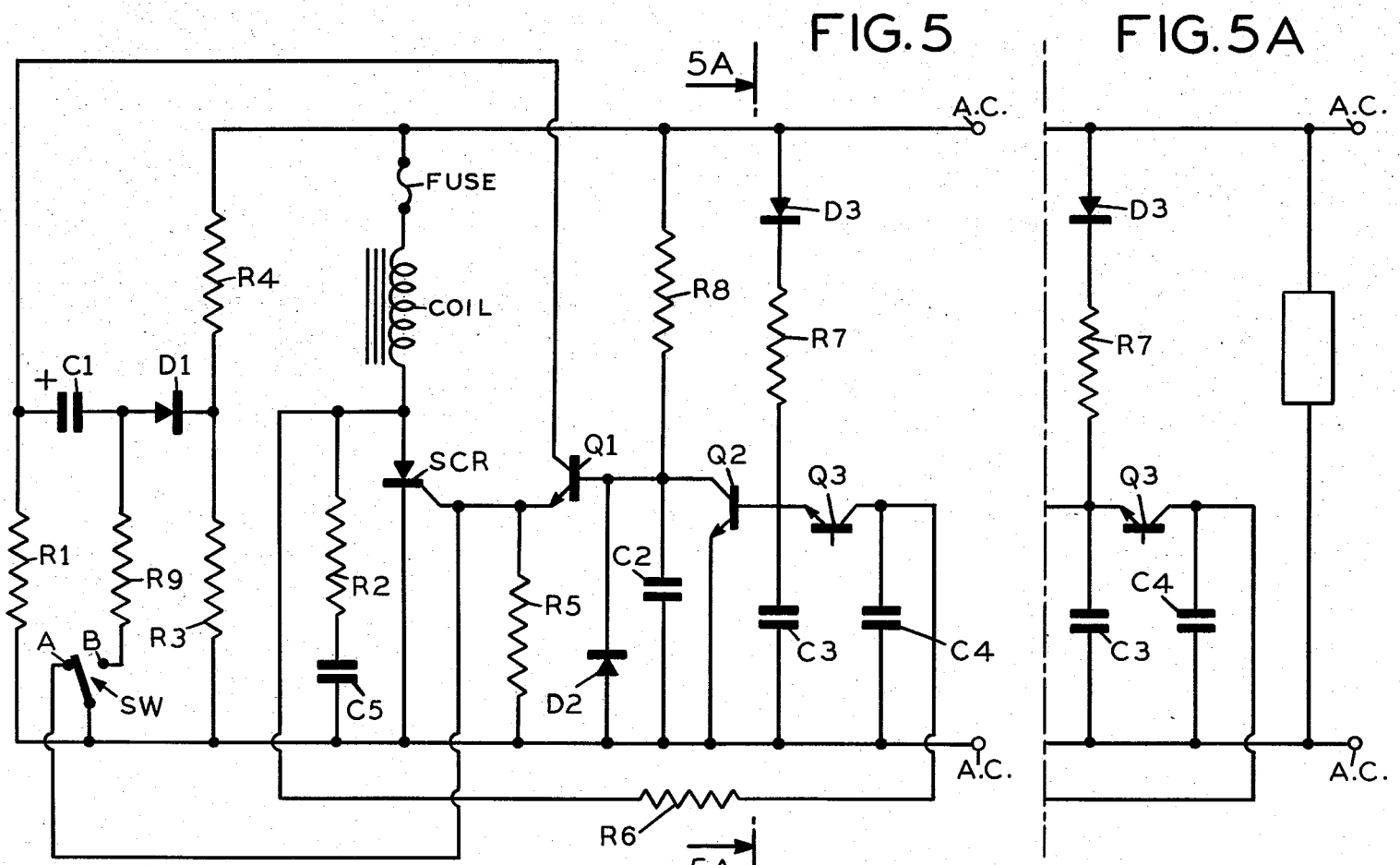
FIG. 5 is a schematic circuit diagram of an electronic pulsing circuit which provides two strokes for each actuation of the trigger and which may be operated either in a 110 V. or 220 V. operational mode.
FIG. 5A is a modification of a portion of the schematic circuit diagram shown in FIG. 5 in which an additional circuit component has been added across the AC line as a safety feature which may be used in either 110 V. or 220 V. operational mode.

The circuits shown in FIGS. 5 and 5A are alternative circuits which assure that the electric stapler provides two strokes to a fastener for each actuation of the trigger. The circuit may be used in either a 110 V. or 220 V. operational mode depending on the values of the circuit components selected as set forth herein.

As shown in FIG. 5, capacitor C1 stores the power which is used to drive the gate of the SCR. C1 is charged when switch SW is open (indicated by position A) by way of the voltage divider of R4 and R3, the rectifier D1 and R1 to about 35 V. (R3/R3+R4)×Peak AC line voltage). When switch SW is closed (indicated by position B) this voltage is made available to the collector of Q1 and further charging of C1 is prevented by the low resistance path between switch SW and capacitor C1 through resistor R9.

Q1, Q2 and their associated base RC's provide for turning on Q1 (and therefore the SCR if SW is closed) for several tenths of a millisecond immediately following each positive-going zero-crossing of the AC line. Transistors Q1 and Q2 are each protected by a diode, D2 and D3, respectively.

The RC circuit which drives the base of Q1 is an order of magnitude faster than the RC circuit which drives the base of Q2. When Q2 turns on it clamps the base of Q1 turning off Q1. Q1 is therefore only on for the short time provided by the difference between the R8C2 time constant and the R7C3 time constant. The result is that if switch SW is closed and C1 is charged, Q1 will drive a pulse into the gate of the SCR and turn it on immediately following each positive zero crossing of the AC line.

Capacitor C1 stores enough power to allow Q1 to pulse on the SCR for a number of consecutive positive half-cycles. The amount of charge removed from C1 each time Q1 turns on the SCR would be relatively small because Q1 only stays on for a short time if not for the action of transistor Q3 which will be discussed in detail below.

In order to prevent the SCR from firing for more than two consecutive positive half-cycles, it is necessary to discharge C1 before the third positive half-cycle can occur. In order to prevent false firings of the SCR from low voltage spikes, there is provided an RC snubber circuit, comprising resistor R2 and capacitor C5 placed across the SCR.

C4 and R6 "see" the AC line voltage when the SCR is off. C4 has a 3.3 V. peak sine wave across it 90° behind the line voltage. When the SCR turns on, the positive half of the AC line is excluded from C4 and R6. At the time the SCR turns on, C4 has −3.3 V. across it. During the half-cycle that the SCR remains on, C4 discharges slightly. During the first negative half-cycle after the SCR had turned on, C4 charges to −9.9 V.

Q3 is used in its reverse breakdown mode. That is, its gate is clipped so that its operation is akin to a Zener diode. Q3 conducts only when the voltage across it, collector to emitter, exceeds about 6.6 V. (at about 1 μa).

When Q3 conducts it holds the base of Q2 out of conduction much longer than the time constant of R7 and C3 normally allow. With Q2 held off longer than normal, Q1 stays on longer after the positive zero crossing of the AC. This extra on time for Q1 allows it to thoroughly discharge C1 and limits the circuit to delivering only two consecutive positive half line cycles to the stapler coil.

The circuit recovers for its next two-shot firing when the switch is released and C1 can be recharged. At the same time C1 is charging, C4 is discharging its DC voltage through R6 since it now "sees" only an AC voltage. A 12 V. AC circuit requires about ⅓ second to recover before its next two-shot cycle. If the circuit is asked to fire before its ⅓ second recovery time has elapsed, it may produce a one-shot instead of two-shot firing.

A list of components for a 110 V. AC 60 Hz circuit is shown in Table 1.

TABLE 1

| Component | Value |
|---|---|
| R-1 | 100 K Ω |
| R-2 | 470 Ω |
| R-3 | 27 K Ω |
| R-4 | 100 K Ω |
| R-5 | 1,000 Ω |
| R-6 | 560 K Ω |
| R-7 | 1,000 K Ω |
| R-8 | 100 K Ω |
| C-1 | 1 μf |
| C-2 | .001 μf |
| C-3 | .001 μf |
| C-4 | .15 μf |
| C-5 | .047 μf |

D1 is a 75 V., 5MA silicon diode (i.e., IN914, IN914A).

D2 is a 400 V., 3A silicon diode (i.e., Motorola MR 504).

Q1 and Q2 are: NPN, Silicon, Vceo 40; hfe 50 to 300 IC Max.=200 MA (i.e., 2N3904 or equivalent).

SCR is a 200 PRV, 8 Amp SCR with a gate turn on current Igt Max. =25 MA for 120 V. applications.

Q3 is a signal type silicon transistor with a reverse breakdown voltage $Vceo_r$=6.6%±20% @1 μa. and a maximum dissipation of 25 mw.

In the 220 V. AC 60 Hz circuit the values of the circuit components are the same as those for the components listed in Table I except as shown in Table 2 below.

TABLE 2

| Component | Value |
|---|---|
| R-4 | 220 K Ω |
| R-6 | 1,200 K Ω |
| R-7 | 2,200 K Ω |
| R-8 | 220 K Ω |

When used in a 220 V. circuit the SCR becomes a 400 PRV, 15 Amp, max. gate current=25 ma.

In the 220 V. circuit, the SCR must be protected from having its maximum peak reverse voltage and breakover voltage ratings exceeded by a power line transient. This requires a varistor or a capacitor directly across the line as shown by the box in FIG. 5A to limit the peak line voltage. A 0.1 μf capacitor will protect against a 3A-10 μsec or a 10A-3 μsec power line transient coinciding with line-voltage peak and an absolute SCR rating of 600 volts. A varistor provides greater protection and is preferred over a line-capacitor.

Although the above circuits have been shown and described as discrete circuits, they can, of course, also be in the form of integrated circuitry.

II. Preferred Mechanical Embodiment

Figures 1, 3A, 3B:
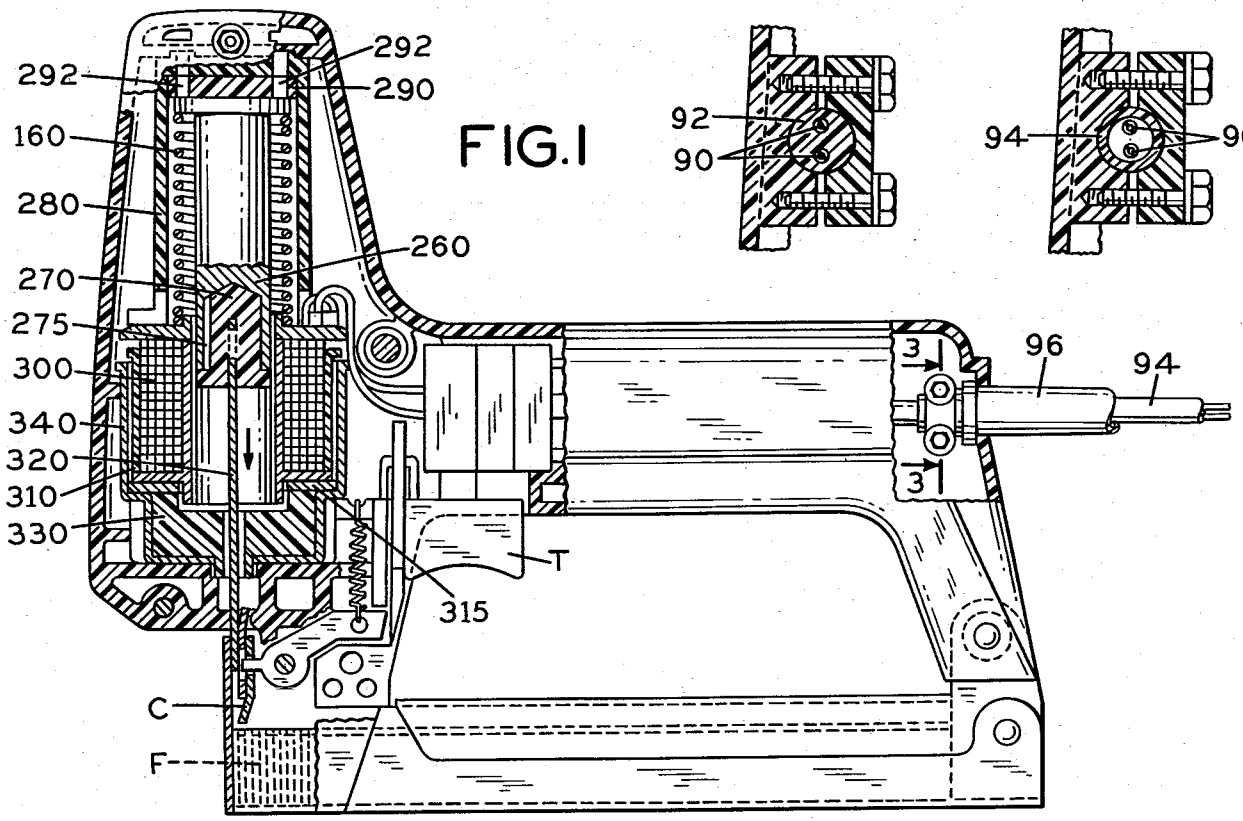
FIG. 1 is a side elevation partly in section of the double insulated fastener.
FIG. 3A is a vertical section taken along line 3—3 of FIG. 1 showing a molded construction about the conductors leading to the terminal.
FIG. 3B is a vertical section similar to FIG. 3A in which the conductors leading to the terminal are individually insulated.
Figure 4:
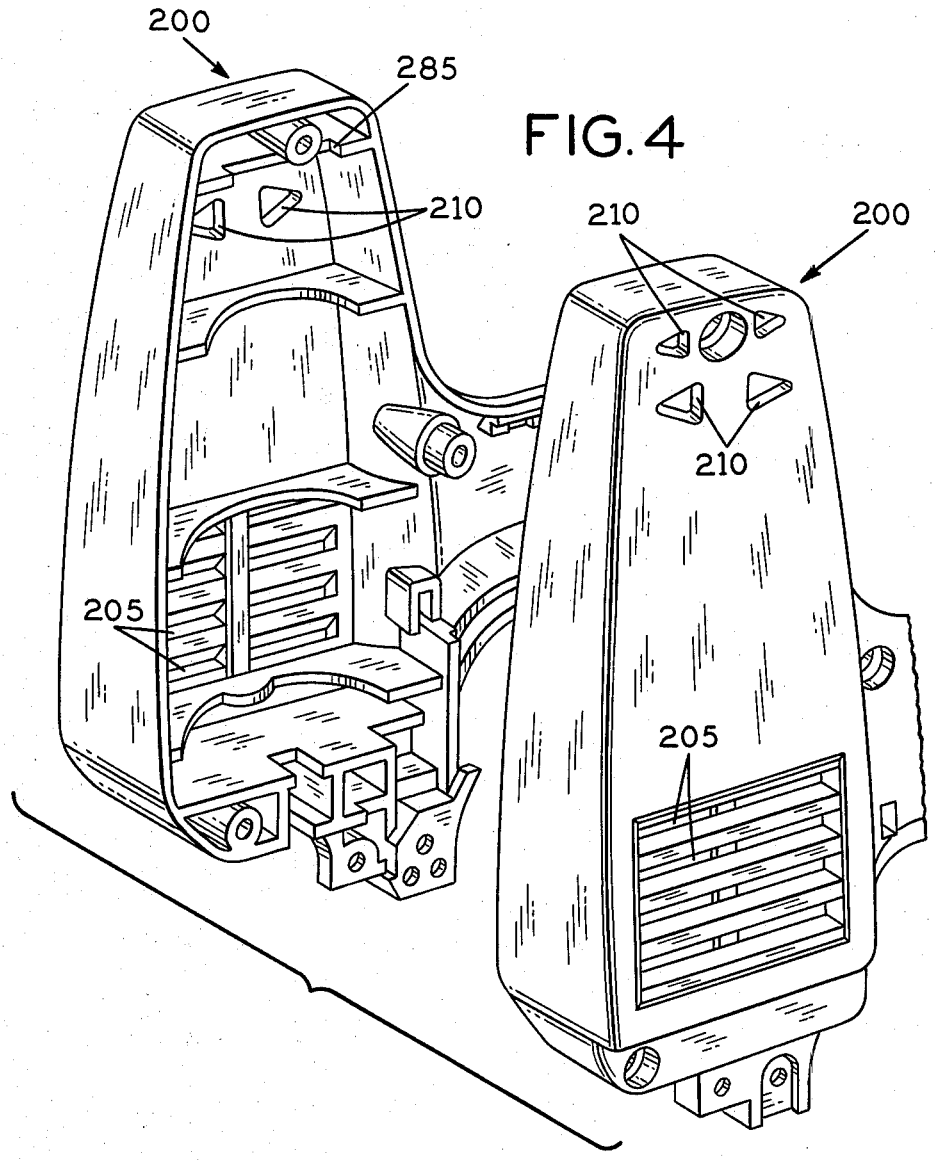
FIG. 4 is a perspective view of the forward portions of the outer casing of the device.

FIG. 1 illustrates the forward portion including an armature assembly of a double insulated two-pulse portable electronic staple gun. The armature assembly is shown in detail in the exploded view of FIG. 2. The armature assembly comprises a plastic interior enclosure or cylinder 280 which is provided with a pair of enlarged vents 282 and a pair of circular ports 284 which help to prevent overheating of the device during operation. Circular ports 284 also aid in the proper alignment of cylinder 280 by abutting against cutout 285 which is shown in FIG. 4. A deformable insulating buffer 290 is friction fitted in the under side of the top of cylinder 280. The insulating buffer 290 is also provided with a pair of circular ports 292 which are aligned with the circular ports 284 of the cylinder 280 and together therewith aid in the ventilation of the device.

The driver blade assembly comprises a plunger 260, a driver blade cap 270 and a driver blade 320. The driver blade cap 270 joins the driver blade 320 to the plunger 260 and insulates it therefrom. Plunger 260 is a solid piece of magnetic material which is provided with a cavity 276 in the center portion of its lower end to permit the driver blade cap 270 to be molded therein. This insulates the metallic driver blade 320 from the plunger 260. The upper portion of the driver blade cap 270 is generally cylindrical except for a portion 275 which is planar to allow for the escape of air when the cap is inserted into the plunger cavity 276. This permits complete insertion of the cap 270 into the cavity 276. There is also provided a spring 160 for normally biasing the driver blade assembly in the "up" or retracted position.

Figure 2:
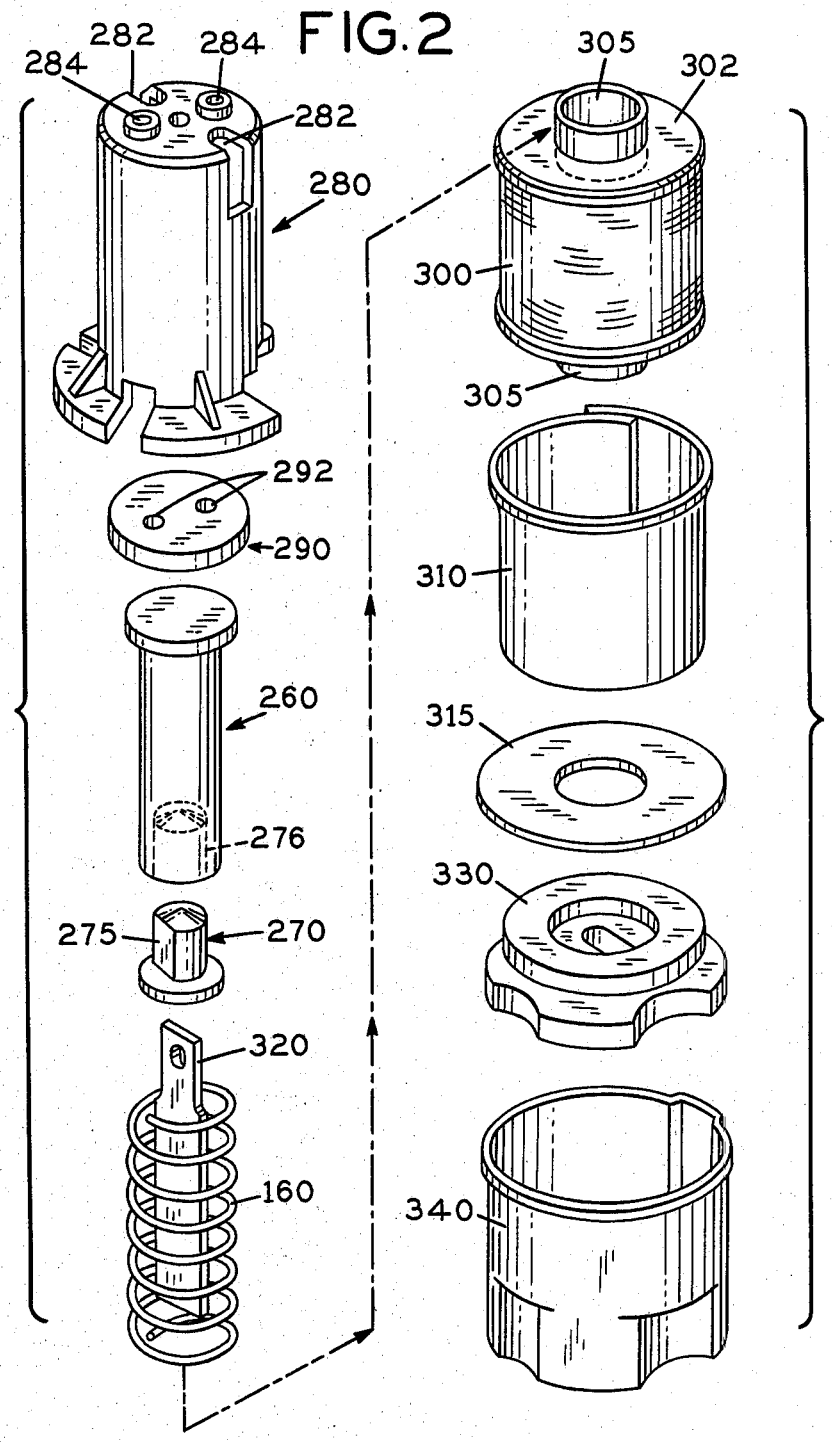
FIG. 2 is an exploded view in perspective showing the interrelationship of the double insulated driver blade and solenoid assembly of FIG. 1.

A solenoid assembly is also illustrated in the exploded view of FIG. 2. The solenoid assembly comprises a winding 300 wound about a spool 302. The spool 302 is provided with an extended core 305 which projects from either end thereof a distance sufficient to eliminate "electrical creep". This is necessary for double insulation of the tool. An insulating overlapping sleeve 310 which is preferably a strip of thin flexible plastic is wrapped around the winding 300. The solenoid assembly is also provided with an annular metallic end plate 315 and a metallic housing 340. On the underside of the winding 300 between the end plate 315 and the housing 340 there is provided a deformable insulating buffer 330.

The assembled tool is shown in partial section in FIG. 1 from which its method of operation can be seen. When trigger T is pulled the circuit is activated as described herein and energizes solenoid 300. Plunger 260 is drawn down into the center of the energized solenoid and driver blade 320 which is attached thereto moves downward also and strikes the forwardmost fastener in a series of fasteners F. The fastener being driven is struck twice by driver blade 320 while the following fasteners are prevented from moving into the driving position by clamp C. The mechanical details and means of operation of clamp C is described more fully in application Ser. No. 880,846, filed Feb. 23, 1978.

FIG. 3 shows a pair of conductors 90 encased in a molded member 92. As an optional safety feature for this tool, the conductors 90 may be individually insulated by sleeve 94 as shown in FIG. 3A. Sleeve 94 is in turn enclosed within line cord 96.

The clam shell construction of the tool is illustrated in FIG. 4 with the internal components not shown. To prevent overheating of the tool during repeated operation, each half clam shell 200 is provided with a plurality of upper vents 210 in the vicinity of the cylinder 280 and louvered openings 205 in the vicinity of the solenoid assembly.

We claim:

1. In an electrically powered driving tool having a hollow body comprising an elongated head portion for housing a cylinder, a solenoid, a magnetic plunger positionable in the cylinder, a driver blade and comprising a hollow handle portion projecting rearwardly from said head portion having trigger means and an electronic trigger control circuit mounted therein for producing two driving strokes to a fastener in response to actuation of said trigger means, a magazine for holding a plurality of fasteners secured to said head portion in driving engagement with said driver blade, means for preventing the advancement of a second fastener into the axial path of said driver blade while a first fastener is being driven the improvement comprising:

(a) said hollow body being made of electrically insulating material;

(b) a cavity in the magnetic plunger; and (c) a molded blade cap which is secured to the blade and in turn positioned in fitting engagement into a cavity in the plunger to structurally hold the cap and blade and to electrically insulate the blade from the plunger, whereby the blade is supported and insulated to prevent the conduct of electricity from the tool interior to the blade.

2. The driving tool according to claim 1 which further comprises a thin insulating sleeve wrapped around said solenoid.

3. The driving tool according to claim 1 which further comprises means for insulating said solenoid from the head portion of the tool.

4. The fastener driving tool according to claim 1 wherein said elongated head portion includes vents for dissipating heat generated during actuation of the tool.

5. The driving tool according to claim 1 wherein said trigger control circuit is operated by a 110 V. AC source.

6. The driving tool according to claim 1 wherein said trigger control circuit is operated by a 220 V. AC source.

7. In an electrically powered portable fastener driving tool, the combination comprising: driving means for driving a fastener, a solenoid including a coil for producing a magnetic field and an armature connected to said driving means for propelling said driving means axially of the coil when the coil is energized, an electronic trigger control circuit connected to the solenoid for supplying the solenoid with two unidirectional current pulses from a source of alternating current supplied to the trigger control circuit, and means for preventing more than one fastener from being driven during a single actuation of the tool, said trigger control circuit including:

(a) unidirectional controlled conduction means for rectifying alternating current comprising at least three terminals including a gate;

(b) first circuit means connecting said solenoid and said controlled conduction means in series with said source of alternating current;

(c) switch means operable at random times relative to the cycles of said alternating current;

(d) second circuit means controlled by said switch means for supplying current to said gate upon actuation of said switch means to place said controlled conduction means in a conductive state two times, firstly immediately following a properly poled half-cycle of said alternating current and secondly, immediately following the next such half-cycle, said circuit including a capacitor which supplies such current;

(e) third circuit means for providing sufficient holding current to the controlled conduction means to enable the controlled conduction means to conduct during two successive like-poled half-cycles of said alternating current; and (f) fourth circuit means for draining sufficient current during the first two successive like-poled half-cycles of said alternating current to assure that no more than two successive current pulses are transmitted to the solenoid during a single actuation of the tool, said fourth circuit means including pulse means which pulses the gate and deactivating means which deactivates the pulse means.

8. The trigger control circuit of claim 7 in which said unidirectional controlled conduction means is an SCR.

9. The trigger control circuit of claim 8 wherein said fourth circuit means comprises a plurality of transistors and an RC circuit of specified time constant associated with each transistor.

10. The trigger control circuit of claim 9 which further comprises means for preventing the maximum peak reverse voltage and breakover voltage of the SCR from being exceeded by a power line transient.

11. The trigger control circuit of claim 10 wherein a varistor is placed across the AC line.

12. The trigger control circuit of claim 10 wherein a capacitor is placed across the AC line.

13. The driving tool according to claim 7 wherein said trigger control circuit is operated by a 110 V. AC source.

14. The driving tool according to claim 7 wherein said trigger control circuit is operated by a 220 V. AC source.

* * * * *